US009808914B2

(12) United States Patent
Wu

(10) Patent No.: US 9,808,914 B2
(45) Date of Patent: Nov. 7, 2017

(54) FASTENER STRUCTURE FOR PLIERS

(71) Applicant: Li-Tu Wu, Taichung (TW)

(72) Inventor: Li-Tu Wu, Taichung (TW)

( * ) Notice: Subject to any disclaimer, the term of this patent is extended or adjusted under 35 U.S.C. 154(b) by 395 days.

(21) Appl. No.: 14/590,787

(22) Filed: Jan. 6, 2015

(65) Prior Publication Data

US 2015/0239101 A1 Aug. 27, 2015

Related U.S. Application Data

(63) Continuation-in-part of application No. 14/188,691, filed on Feb. 25, 2014.

(51) Int. Cl.
*B25B 7/14* (2006.01)
*B25B 7/06* (2006.01)
*B25B 7/08* (2006.01)

(52) U.S. Cl.
CPC . *B25B 7/14* (2013.01); *B25B 7/08* (2013.01)

(58) Field of Classification Search
CPC ..... B25B 7/08; B25B 7/14; B26B 13/16
USPC ..... 81/321–325
See application file for complete search history.

(56) References Cited

U.S. PATENT DOCUMENTS 5,297,343 A * 3/1994 Melter ..... B26B 29/04 30/143
6,301,787 B2 * 10/2001 Mock ..... B26B 13/16 30/252
6,336,272 B1 * 1/2002 Lee ..... B26B 13/16 30/261
7,055,414 B2 * 6/2006 Konen ..... B25B 7/00 267/166
2007/0144015 A1 * 6/2007 Peterson ..... B26B 13/06 30/262

* cited by examiner

*Primary Examiner* — Hadi Shakeri

(57) ABSTRACT

A fastener structure for pliers contains: a first connecting arm, a second connecting arm, and a slidable fastener. The first connecting arm is rotatably connected with the second connecting arm to form a griping segment and a working segment and includes a holder which has two guiding rails. The first connecting arm also includes a first notch and a second notch, and the second connecting arm includes a locking seat. The slidable fastener is hollow and retains with the holder, and the slidable fastener includes two guide posts, a positioning plate, and an elastic locker mounted on the positioning plate to alternatively retain with the first notch or the second notch, such that when the elastic locker retains with the first notch, the positioning plate limits the locking seat, and when the elastic locker retains with the second notch, the positioning plate releases the locking seat.

2 Claims, 7 Drawing Sheets

FASTENER STRUCTURE FOR PLIERS

CROSS-REFERENCE TO RELATED APPLICATIONS

This application is a continuation-in-part of U.S. application Ser. No. 14/188,691, filed on Feb. 25, 2014, the contents of which are incorporated herein by reference.

FIELD OF THE INVENTION

The present invention relates to a fastener structure for pliers which is configured between two handles of the pliers to fasten or unfasten the two handles safely.

BACKGROUND OF THE INVENTION

Conventional cutting pliers or clamping pliers contain two handles rotatably connected together and two clamp jaws opposite to the two handles. As operating the cutting pliers, one of the two handles is gripped by user's thumb and web space, and the other handle is clamped and pressed by other fingers, such that the two handles are manually expanded and retracted. However, after retracting the pliers, the two handles are expanded opposite to a forcing direction of the fingers to cause using inconvenience. To overcome such a problem, an elastic element is defined between the two handles of the pliers to push the two handles outwardly, thus expanding the two handles.

To avoid injuring the user, a retractable fastener is mounted on a distal end of the pliers to retract the pliers. Nevertheless, in operation, the retractable fastener is released or retracted by the user's other hand, thus operating the pliers inconveniently.

The present invention has arisen to mitigate and/or obviate the afore-described disadvantages.

SUMMARY OF THE INVENTION

The primary objective of the present invention is to provide a fastener structure for pliers which is configured between two handles of the pliers to fasten or unfasten the two handles safely.

To obtain the above objective, a fastener structure for pliers provided by the present invention contains: a first connecting arm, a second connecting arm, and a slidable fastener.

The first connecting arm is rotatably connected with the second connecting arm, such that a griping segment and a working segment are formed, the first connecting arm includes a holder disposed on a first inner wall of the griping segment, and the holder has two guiding rails fixed on two sides of the holder, a first notch defined on an outer surface thereof, and a second notch also defined on the outer surface thereof, the second connecting arm includes a locking seat secured on a second inner wall of the griping segment opposite to the first inner wall of the gripping segment.

The slidable fastener is hollow and retains with the holder, and the slidable fastener includes two guide posts disposed on two sides of an inner surface thereof, a positioning plate formed on an outer surface thereof to limit or release the locking seat, and an elastic locker mounted on an inner wall of the positioning plate to alternatively retain with the first notch or the second notch, such that when the elastic locker retains with the first notch, the positioning plate limits the locking seat, and when the elastic locker retains with the second notch, the positioning plate releases the locking seat.

Thereby, the fastening structure contains the slidable fastener to release or limit the first connecting arm and the second connecting arm so that the working segment is retracted safely. Furthermore, the slidable fastener is fixed on the gripping segment proximate to the connection portion of the two handles to correspond to the user's thumb, such that the slidable fastener is pushed easily by the user's thumb to release or limit the pliers.

DETAILED DESCRIPTION OF THE PREFERRED EMBODIMENTS

Figure 1:
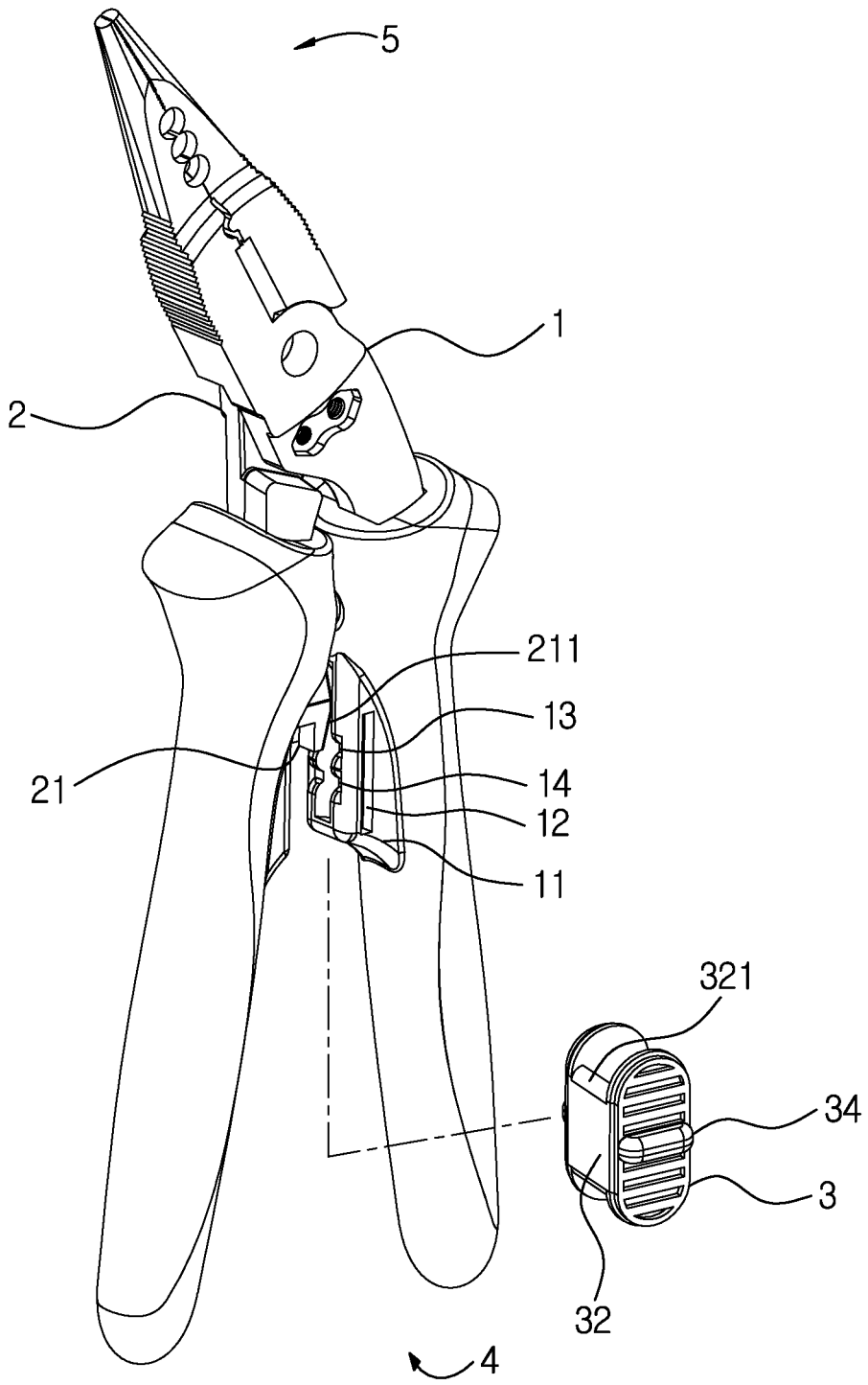
FIG. 1 is a perspective view showing the exploded components of a fastener structure for pliers according to a preferred embodiment of the present invention.
Figure 2:
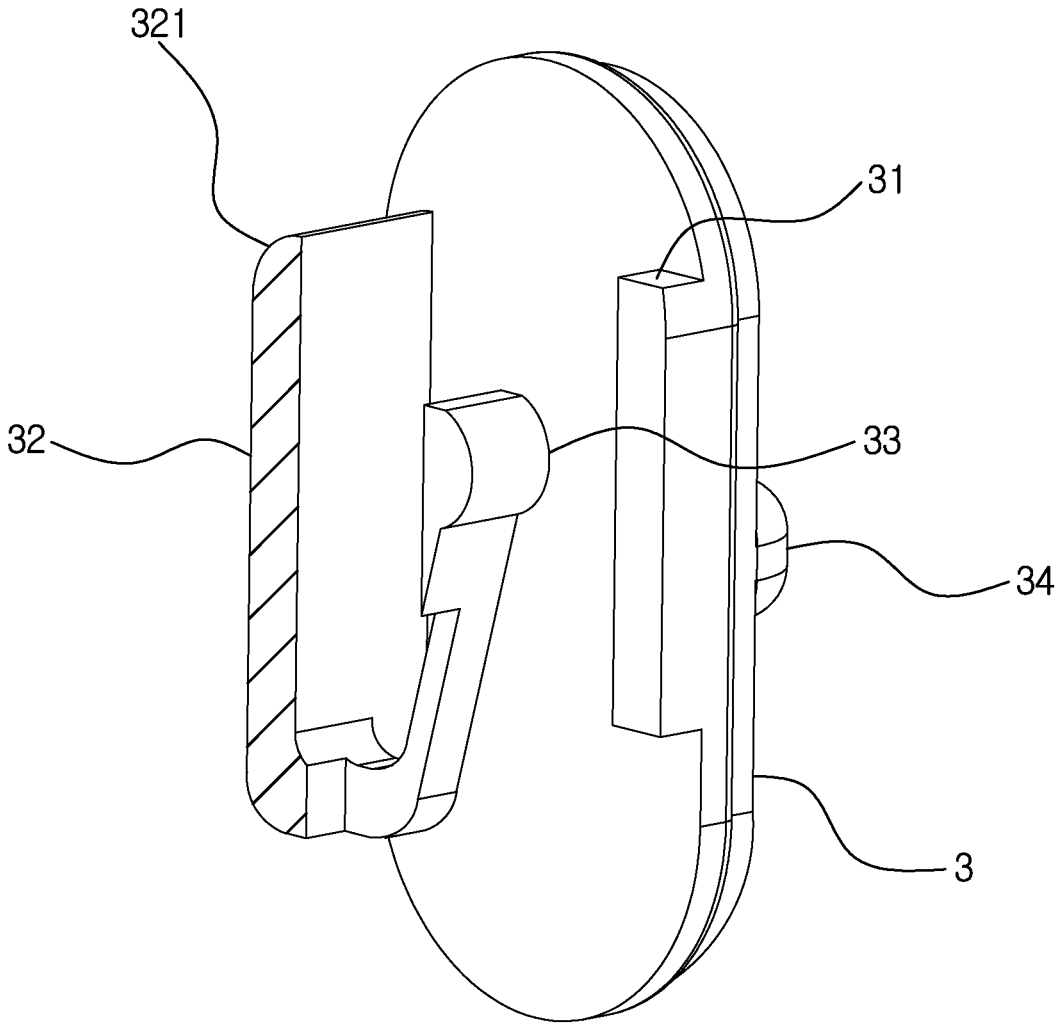
FIG. 2 is a cross-sectional perspective view showing the assembly of a slidable fastener of the fastening structure for the pliers according to the preferred embodiment of the present invention.
Figure 3:
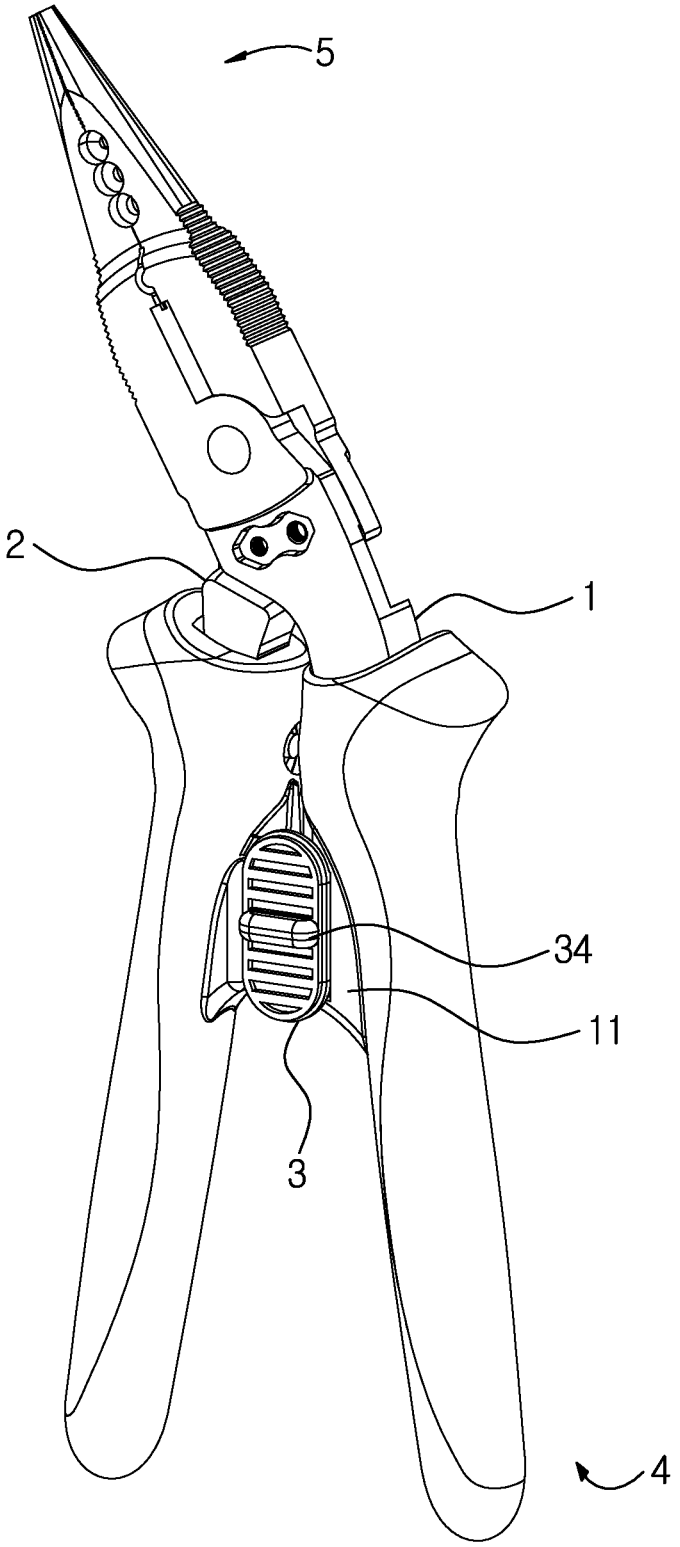
FIG. 3 is a perspective view showing the assembly of the slidable fastener of the fastening structure for the pliers according to the preferred embodiment of the present invention.
Figure 4:
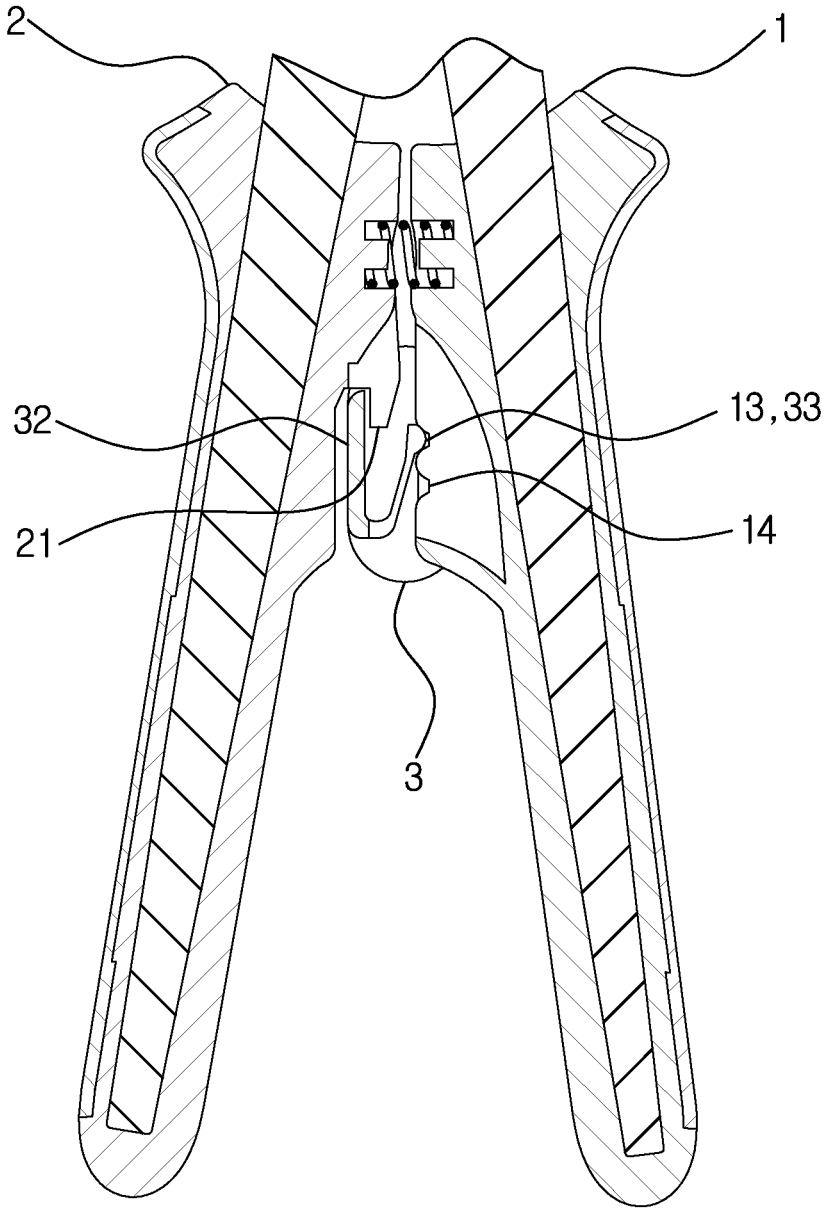
FIG. 4 is a cross sectional view showing the operation of the fastening structure for the pliers according to the preferred embodiment of the present invention.
Figure 5:
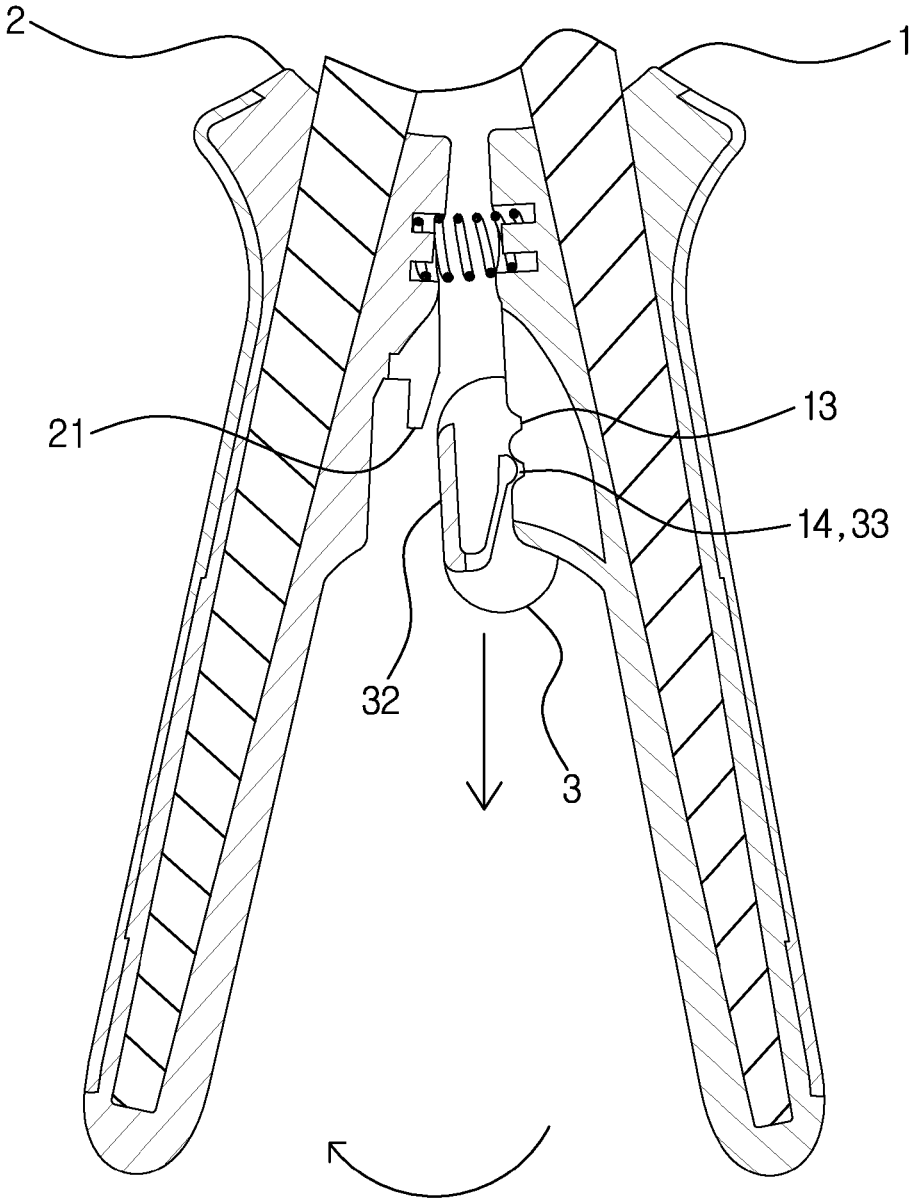
FIG. 5 is another cross sectional view showing the operation of the fastening structure for the pliers according to the preferred embodiment of the present invention.

With reference to FIGS. 1-7, a fastener structure for pliers according to a preferred embodiment of the present invention is configured between two handles of the pliers to fasten or unfasten the two handles safely. The fastening structure comprises: a first connecting arm 1, a second connecting arm 2, and a slidable fastener 3.

The first connecting arm 1 is rotatably connected with the second connecting arm 2, such that a griping segment 4 and a working segment 5 are formed (In this embodiment, the working segment 5 is clamp pliers, and it can be also cutting pliers in another embodiment). The first connecting arm 1 includes a holder 11 disposed on a first inner wall of the griping segment 4, and the holder 11 has two guiding rails 12 fixed on two sides of the holder 11, a first notch 13 defined on an outer surface thereof, and a second notch 14 also defined on the outer surface thereof. The second connecting arm 2 includes a locking seat 21 secured on a second inner wall of the griping segment 4 opposite to the first inner wall of the gripping segment 4.

The slidable fastener 3 is hollow and retains with the holder 11, and the slidable fastener 3 includes two guide posts 31 disposed on two sides of an inner surface thereof, a positioning plate 32 formed on an outer surface thereof to limit or release the locking seat 21, and an elastic locker 33 mounted on an inner wall of the positioning plate 32 to alternatively retain with the first notch 13 or the second notch 14, such that when the elastic locker 33 retains with the first notch 13, the positioning plate 32 limits the locking seat 21, and when the elastic locker 33 retains with the second notch 14, the positioning plate 32 releases the locking seat 21.

Thereby, after sliding the slidable fastener 3, the first connecting arm 1 and the second connecting arm 2 are released or limited by the positioning plate 32 and the locking seat 21, such that the working segment 5 is clamped safely. Preferably, the slidable fastener 3 is fixed on the gripping segment 4 proximate to a connection portion of the two handles to correspond to a user's thumb, such that the slidable fastener 3 is pushed easily by the user's thumb to release or limit the pliers.

Figure 6:
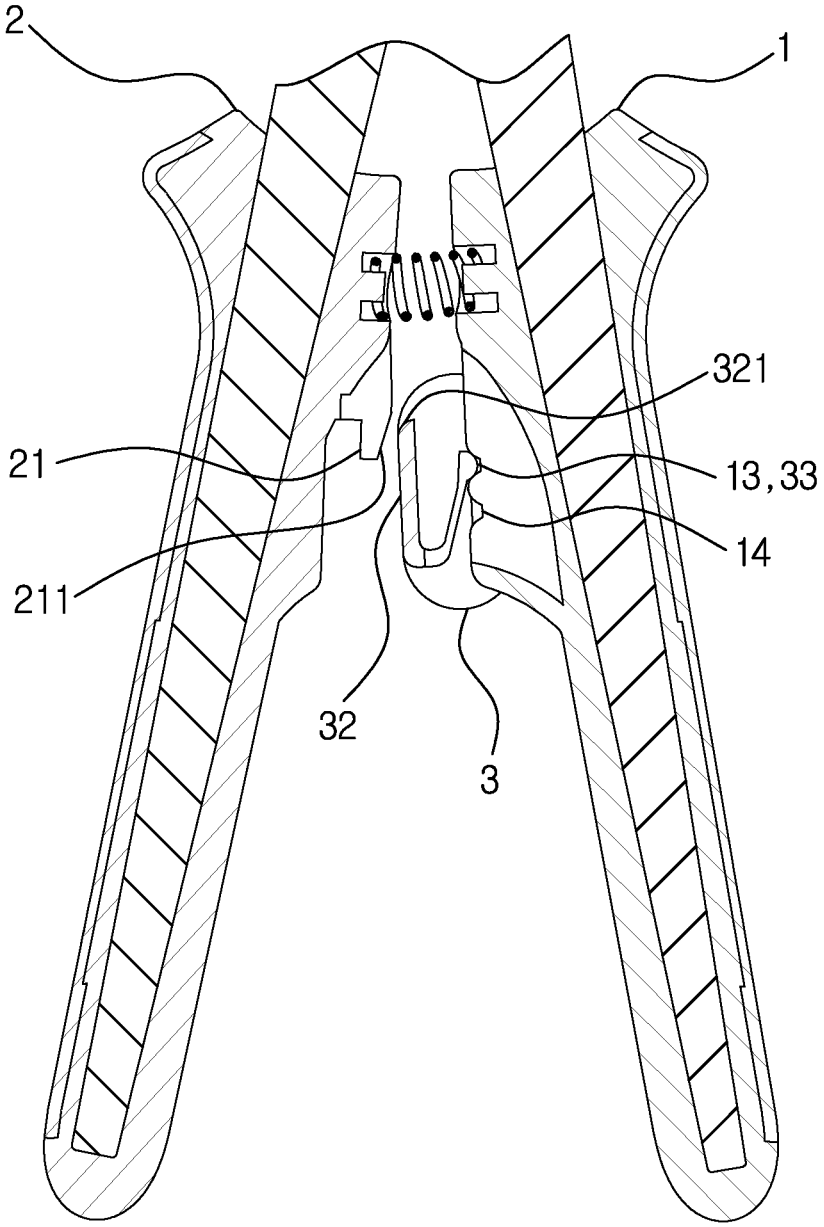
FIG. 6 is also another cross sectional view showing the operation of the fastening structure for the pliers according to the preferred embodiment of the present invention.
Figure 7:
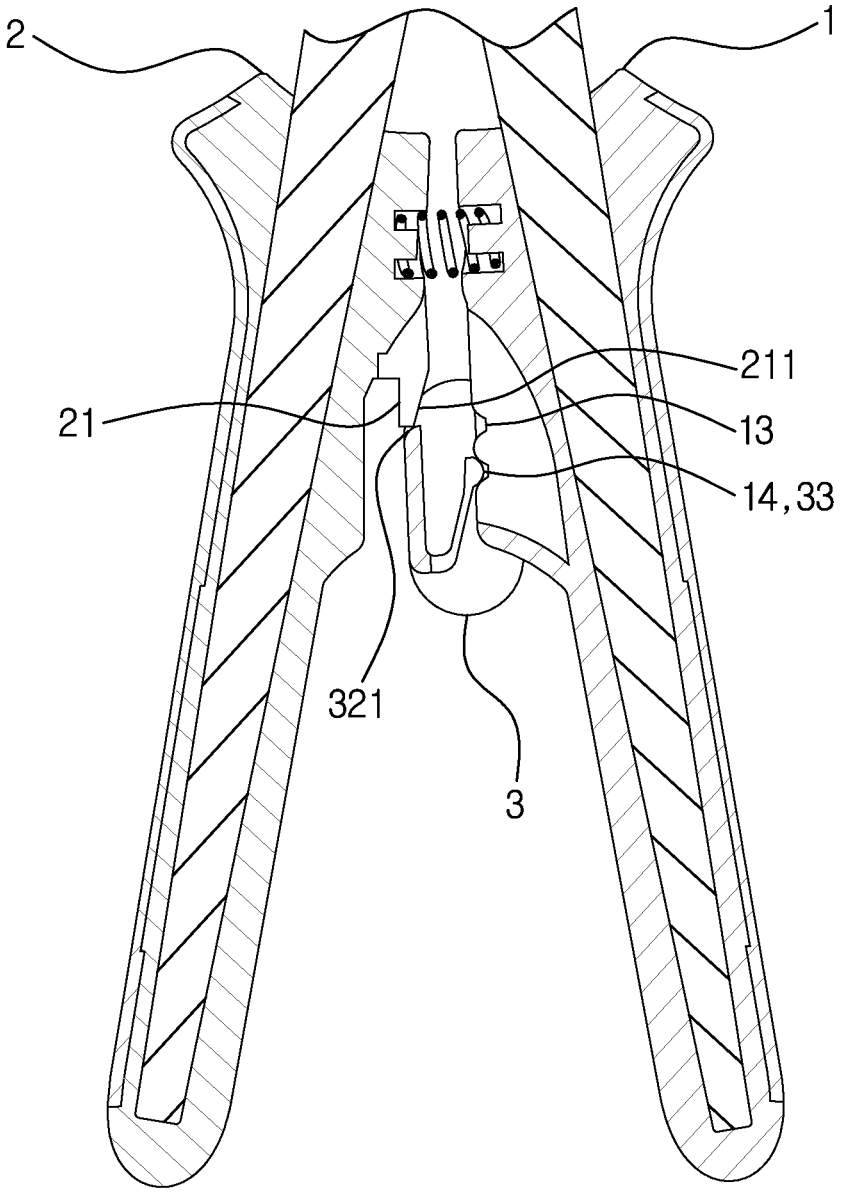
FIG. 7 is still another cross sectional view showing the operation of the fastening structure for the pliers according to the preferred embodiment of the present invention.

Furthermore, the locking seat 21 has a tilted face 211 defined on a bottom surface thereof, and the positioning plate 32 has an arcuate face 321 formed on a top end thereof to correspond to the tilted face 211, such that the arcuate face 321 is pushed by the tilted face 211 to actuate the slidable fastener 3 to slide downwardly. In operation, when the slidable fastener 3 is located at an interfering position to interface the locking seat 21 (as shown in FIG. 6, the slidable fastener 3 does not retain with the locking seat 21 and corresponds to the locking seat 21), the tilted face 211 and the arcuate face 321 force the slidable fastener 3 to remove after pressing the pliers, thus avoiding interfering the pliers (as illustrated in FIG. 7).

In addition, the slidable fastener 3 further includes two projections 34 arranged on an outer surface thereof to be pushed or pressed by the user's thumb easily.

Thereby, the fastening structure comprises the slidable fastener 3 to release or limit the first connecting arm 1 and the second connecting arm 2 so that the working segment 5 is retracted safely. Furthermore, the slidable fastener 3 is fixed on the gripping segment 4 proximate to the connection portion of the two handles to correspond to the user's thumb, such that the slidable fastener 3 is pushed easily by the user's thumb to release or limit the pliers.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A fastener structure for pliers comprising: a first connecting arm, a second connecting arm, and a slidable fastener; wherein:

the first connecting arm is rotatably connected with the second connecting arm, such that a griping segment and a working segment are formed, the first connecting arm includes a holder disposed on a first inner wall of the griping segment, and the holder has two guiding rails fixed on two sides of the holder, a first notch defined on an outer surface thereof, and a second notch also defined on the outer surface thereof, the second connecting arm including a locking seat secured on a second inner wall of the griping segment opposite to the first inner wall of the gripping segment; and the slidable fastener is hollow and retains with the holder, and the slidable fastener includes two guide posts disposed on two sides of an inner surface thereof, a positioning plate formed on an outer surface thereof to limit or release the locking seat, and an elastic locker mounted on an inner wall of the positioning plate to alternatively retain with the first notch or the second notch, such that when the elastic locker retains with the first notch, the positioning plate limits the locking seat, and when the elastic locker retains with the second notch, the positioning plate releases the locking seat;

wherein the locking seat has a tilted face defined on a bottom surface thereof, and the positioning plate has an arcuate face formed on a top end thereof to correspond to the tilted face, such that the arcuate face is pushed by the tilted face to actuate the slidable fastener to slide downwardly.

2. The fastener structure for pliers as claimed in claim 1, wherein the slidable fastener further includes two projections arranged on an outer surface thereof.

* * * * *